US005158303A

United States Patent [19]

Lat

[11] Patent Number: 5,158,303

[45] Date of Patent: Oct. 27, 1992

[54] DEVICE FOR DEVELOPING AND TESTING EYE-HAND COORDINATION

[76] Inventor: Paul E. Lat, 9246 Lawndale, St. Louis, Mo. 63126

[21] Appl. No.: 812,633

[22] Filed: Dec. 23, 1991

[51] Int. Cl.[5] ..... A63F 9/00

[52] U.S. Cl. ..... 273/441

[58] Field of Search ..... 273/441, 442

[56] References Cited

U.S. PATENT DOCUMENTS

| | | | |
|---|---|---|---|
| D. 207,104 | 3/1967 | Tiarks | D34/5 |
| 2,508,146 | 5/1950 | D'Elia | 35/22 |
| 3,208,747 | 9/1965 | Kavakos | 273/1 |
| 3,913,909 | 10/1975 | Bissell | 273/1 |
| 4,174,833 | 11/1979 | Henning et al. | 273/442 |
| 4,239,213 | 12/1980 | Jarvis | 273/1 |
| 4,892,306 | 1/1990 | Kawar | 273/1 |

OTHER PUBLICATIONS

Practical Electronics, 3-1982 vol. 18 No. 3 pp. 36-37 Bent Wire Game.

Radio and Electronics Constructor, 4-1975 vol. 28 No. 9 pp. 556-557 Hand Tremor Detector.

Plaything, 8-1959 p. 52 Beat the Buzz.

*Primary Examiner*—Paul E. Shapiro

*Attorney, Agent, or Firm*—Grace J. Fishel

[57] ABSTRACT

A device for developing and testing eye-hand coordination of the kind wherein a signal is generated when a conductive loop contacts a conductive track as the loop is passed therealong. The loop has stacked lobes of varying size and is mounted at one end of an elongated handle having markings at intervals of increased distance from the loop. The track is malleable. A control circuit includes a timer which activates a signal for a predetermined time when the loop touches the track.

10 Claims, 2 Drawing Sheets

DEVICE FOR DEVELOPING AND TESTING EYE-HAND COORDINATION

The present invention relates to a device for developing and testing eye-hand coordination. The difficulty of the device can be regulated in several ways so that different users can be continually challenged using the same device. The device is of the kind wherein a signal is generated when a conductive loop contacts a conductive track as the loop is passed therealong.

BACKGROUND OF THE INVENTION

There exist many game devices of the conductive loop and conductive track kind. One problem with these games, however, is that the user tends to get bored after he has tried these games a few times. This problem has been addressed in some of the games by providing a way to increase (or change) the difficulty of the game. For example, U.S. Pat. No. 4,892,306 to Kawar discloses a game wherein the track member has a plurality of segments of sequentially stepped diameter. Difficulty of play in this game increases with the diameter of the segments. U.S. Pat. No. 4,239,213 to Jarvis discloses a game wherein the conductive track is convoluted and can be swiveled. U.S. Pat. No. 3,913,909 to Bissell discloses a game wherein there are loops of different size.

The method used in U.S. Pat. No. 4,892,306 to increase the difficulty of the game is mechanically complex and the game is expensive to make. The method used in U.S. Pat. No. 4,239,213 is limited to changing the convolutions of the track or angle at which the track is presented to the user. The method used in U.S. Pat. No. 3,913,909 is limited to making a selection between two loops.

The number of game devices of the above-mentioned type indicates that there is public interest in using them for amusement as in a pay-for-play (e. g., carnival) environment. They would also be useful in developing and testing eye-hand coordination if there was an inexpensive device that increased or continually changed the level of difficulty and thereby could be used to improve fine and gross motor skills in a home or rehabilitation environment.

OBJECTS AND SUMMARY OF THE INVENTION

It is an important object of the present invention to provide a device wherein the difficulty can be regulated in a number of different ways.

When the device is used as a game, it is also an important object to provide a means for eliminating user interpretation as to whether the loop touched the track. Other objects and features of the invention will be in part apparent and in part pointed out.

In accordance with the invention, a device has an electrically conductive track attached to an insulated base. A conductive loop is attached to an insulated handle. The conductive loop is formed in a figure with stacked lobes of varying size. The lobes are adapted to be received around and be moved axially along the conductive track. There is a gap at the crossover point between adjacent lobes. The gap is slightly larger than the outside dimension of the conductive track so that the user can select between or among the lobes as a way to regulate the level of difficulty. A control circuit is connected to a power supply and to the conductive track and the conductive loop. The control circuit activates a signal when the conductive loop touches the conductive track.

In one form, the conductive track is malleable so that the track can be configured by the user as a second way to regulate the difficulty of the device.

In another form, the handle is elongated and provided with markings indicating increased distance from the loop. This provides the user with a third way to regulate the difficulty of the device by selecting the handhold distance to the loop. In still yet another form, the control circuit includes a timer which activates the signal for a predetermined time when the conductive loop touches the conductive track to eliminate any room for interpretation as to whether contact was actually made.

The invention as summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
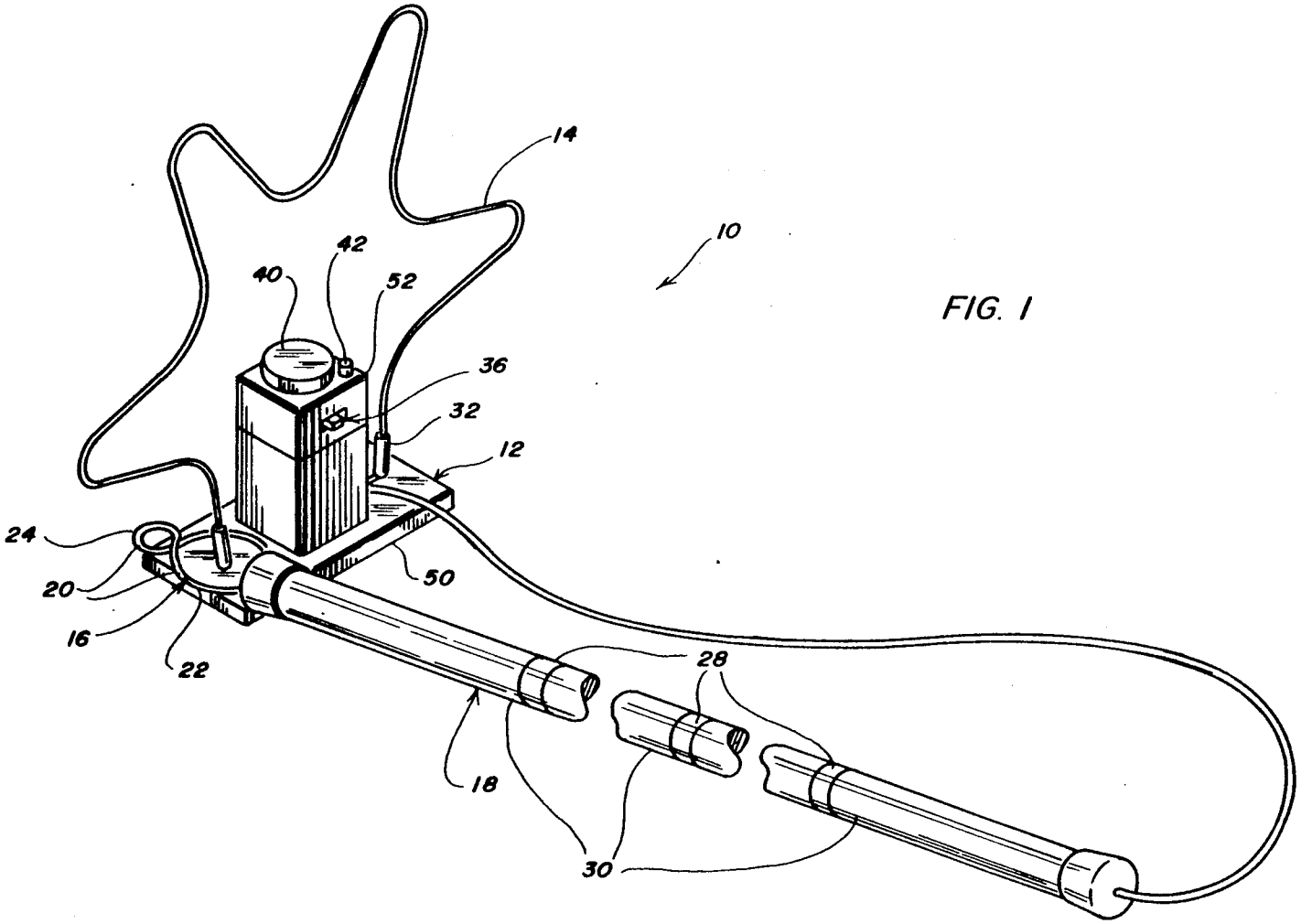
FIG. 1 is a perspective view of a device in accordance with the present invention.
Figure 2:
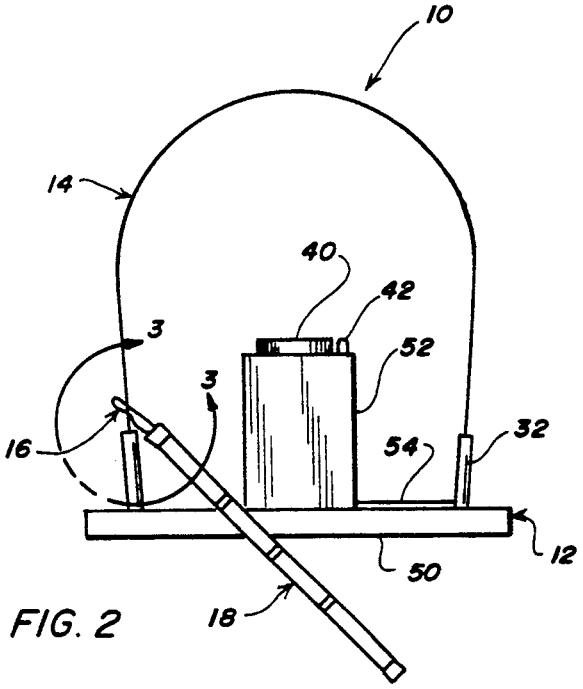
FIG. 2 is a front elevational view of the device shown in FIG. 1 but with the electrically conductive track in the form of an arch representing its simplest form.

Referring to the drawings more particularly by reference character, reference numeral 10 refers to a device in accordance with the present invention. As shown in FIGS. 1 and 2, device 10 has an insulated base 12 to which a track 14 is attached. Track 14 forms a closed loop on base 12 and can be made of any electrically conductive and malleable material such as brass, steel or the like. Track 14 must be sufficiently rigid to hold a shape after it is bent into a selected pattern. As illustrated in the drawings, track 14 is formed of a wire having a solid or tubular section with opposite ends attached to base 12.

Figure 3:
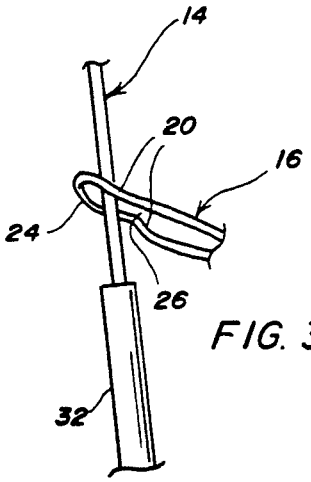
FIG. 3 is a detailed view on an enlarged scale taken along line 3—3 in FIG. 2; and, FIG. 4 is a schematic diagram indicating the circuitry employed in the device.

A conductive loop 16 is attached to an insulated handle 18. Conductive loop 16 is formed as a figure with stacked lobes 20 adapted to be received around and moved axially along conductive track 14. As illustrated in the drawings, conductive loop 16 is a figure eight with a larger lobe 22 and a smaller lobe 24 but it will be understood that there may be more than two stacked lobes of different size. As shown in FIG. 3, there is a gap 26 at the crossover point between adjacent lobes. Gap 26 is slightly larger than the outside dimension of conductive track 14 so that a user can select between the smaller and larger lobes of conductive loop 16, as shown in the drawing, or among the lobes when there are more than two.

As shown in the drawings, handle 18 is elongated and provided with a plurality of markings 28 at selected intervals 30, forming handholds, with increased distance from conductive loop 16. At each end of conductive track 14, the malleable conductor extends through some sort of insulator, such as plastic sleeves 32, where it is attached to base 12. Sleeves 32 enable conductive loop 16 on handle 18 to be rested at either end of conductive track 14 without making contact between the two conductive members.

Figure 4:
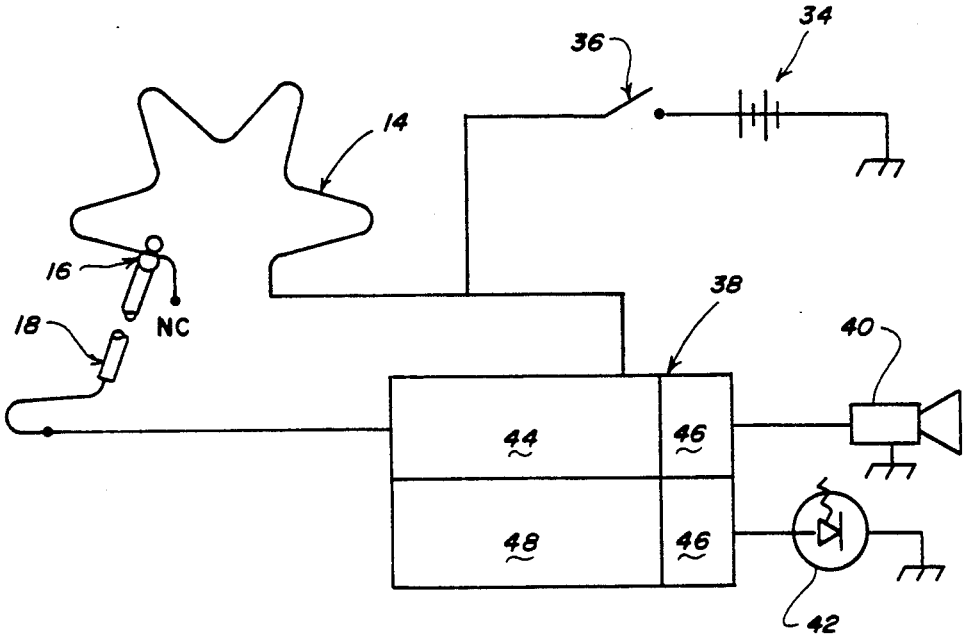

Conductive track 14 and conductive loop 16 form part of an electric circuit represented schematically in FIG. 4. The electric circuit illustrated in FIG. 4 includes a power supply 34 such as a conventional 9V battery connected to one side of a switch 36. The other side of switch 36 is connected to a control circuit 38 and to conductive track 14 and conductive loop 16.

Control circuit 38 activates an audible signal 40 or visible signal 42 or both, when conductive loop 16 touches conductive track 14. In a desired form, control circuit 38 includes a timer 44. When conductive loop 16 touches conductive track 14, control circuit 38 activates signal(s) 40, 42 for a predetermined time to eliminate any room for interpretation (i.e., argument between or among the users) as to whether contact was made. Audible signal 40 can take a variety of forms, for example, it can be a speaker (as shown), buzzer, bell or the like and visible signal 42 can also take a number of forms, for example, an LED (as shown), light bulb or the like.

Control circuit 38 may include other functions, for example as shown, amplification circuitry 46 for the audible and/or visible signals. It may also include a tone generator 48 such as an oscillator to modulate the audio signal provided to the speaker. In other instances, it may include a counter to total the number of contacts between conductive loop 16 and conductive track 14 to provide a score. It may also include a display to record the elapsed time taken by the user and so forth.

Power supply 34 and control circuit 38 are housed in base 12. In the form illustrated, base 12 comprises a plate 50 with an upstanding hollow compartment 52 for the power supply and control circuit. It will be understood, however, that in other embodiments, plate 50 can be hollow and compartment 52 eliminated as a separate component. As shown in FIGS. 1 and 2, the bare ends of conductive track 14 pass through sleeves 32 and are attached to plate 50 by threaded fasteners or the like such that track 14 straddles compartment 52. An electrical lead 54 connects one end of conductive track 14 to switch 36. In addition to housing power supply 34 and control circuit 38, base 12 (illustrated as the outer surface of compartment 52) provides a place for mounting switch 36 (shown as a slide switch) and audible and visible signals 40, 42 illustrated as a speaker and LED, respectively.

In use, the object of device 10 is for the user to center a selected lobe 20 of conductive loop 16 around conductive track 14 and to move the loop with handle 18 from one end to the other end of conductive track 14 without touching the conductive loop 16 to the conductive track 14. In the form illustrated in the drawings, there are three independent ways in which the difficulty of the device can be regulated.

One way is by bending malleable conductive track 14. As will be appreciated by a user who tries it, it is much more difficult to pass conductive loop 16 along the convoluted conductive track 14 shown in FIG. 1 than along the straight track shown in FIG. 2. Another independent way to regulate the difficulty of the device is by selecting a smaller lobe of conductive loop 16. Clearly, the smaller the lobe, the more dexterity will be required to pass loop 16 along conductive track 14. Finally, by selecting the interval 30 used as a handhold, the user can increase or decrease the amount of fine and gross motor skills it takes to use the device. Any trembling of the user's hand will be amplified with increasing distance of the handhold from the loop.

Device 10 described above is an entertaining developmental tool for use by children in improving fine and gross motor skills. Its use, however, is not limited to children. It can be used for developing or rehabilitating fine and gross motor skills in occupational therapy, rehabilitation after injury or in out-patient clinics. It can also be used strictly for amusement. When device 10 is used in the above mentioned ways or if it is used in a pay-for-play (e. g. carnival) situation, timer 44 helps to eliminate any argument as to whether contact was made.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A device for developing and testing eye-hand coordination comprising:

an insulated base;

an electrically conductive track attached to the base;

a conductive loop attached to an insulated handle, said conductive loop being formed from a continuous wire crossing itself at one or more points to form a closed figure with a plurality of lobes of different size adapted to be received around and moved axially along the conductive track and a gap between adjacent sections of the wire at each crossover point between adjacent lobes, said gap being slightly larger than the outside dimension of the conductive track so that the user can pass the track through the gap to select between or among the lobes as a way to regulate the level of difficulty;

a power supply;

a control circuit connected to the power supply and to the conductive track and the conductive loop for activating a signal when the conductive loop touches the conductive track.

2. The device of claim 1 wherein said conductive track is malleable so that the track can be configured by the user as a second way to regulate the level of difficulty.

3. The device of claim 2 wherein the handle is elongated with markings at intervals indicating increased distance from the loop so that by selecting the handhold the user has a third way to regulate the level of difficulty.

4. The device of claim 3 wherein the control circuit includes a timer which activates the signal for a predetermined time when the conductive loop touches the conductive track.

5. A device for developing and testing eye-hand coordination comprising:

an insulated base;

an electrically conductive wire track attached to the base;

a conductive loop attached to an insulated elongated handle, said conductive loop formed in a figure with stacked lobes of varying size adapted to be received around and moved axially along the conductive track and a gap at the crossover point between adjacent lobes, said gap being slightly larger than the outside diameter of the conductive track so that the user can select between or among the lobes as a first way to regulate the difficulty level of usage, said conductive track being malleable so that the track can be configured by the user as a second way to regulate the difficulty level of usage, and said insulated elongated handle having markings at intervals indicating increased distance from the loop so that by selecting the handhold the user has a third way to regulate the difficulty level of usage;

a power supply;

a control circuit connected to the power supply and to the conductive track and the conductive loop for activating a signal when the conductive loop touches the conductive track, said control circuit having a timer which activates the signal for a predetermined time when the conductive loop touches the conductive track to eliminate any room for interpretation as to whether contact was made.

6. The device of claim 5 wherein the control circuit activates an audio signal.

7. The device of claim 5 wherein the control circuit activates a visible signal.

8. The device of claim 5 wherein the control circuit activates both a visible and an audio signal.

9. The device of claim 5 wherein the malleable conductive track forms a closed loop on the base.

10. The device of claim 9 wherein the ends of the malleable conductive track are shielded by insulative sleeves so that the conductive loop can be rested at either end of the malleable conductive track without making contact between the conductive loop and the conductive track.

* * * * *